US006386217B1

(12) United States Patent
Cooper et al.

(10) Patent No.: US 6,386,217 B1
(45) Date of Patent: May 14, 2002

(54) AXILLARY CRUTCH

(75) Inventors: Barbara Cooper, Hamilton; Derek Clark, Burlington; John Campa, Toronto; Antonio Bellusci, Mississauga, all of (CA)

(73) Assignee: McMaster University, Hamilton (CA)

( * ) Notice: Subject to any disclaimer, the term of this patent is extended or adjusted under 35 U.S.C. 154(b) by 0 days.

(21) Appl. No.: 09/698,222

(22) Filed: Oct. 30, 2000

(30) Foreign Application Priority Data

Oct. 29, 1999 (CA) ..... 2287886

(51) Int. Cl.[7] ..... A45B 9/00

(52) U.S. Cl. ..... 135/74; 135/66; 135/68; 135/69; 135/75

(58) Field of Search ..... 135/66, 68, 74, 135/75, 69

(56) References Cited

U.S. PATENT DOCUMENTS

| | | | | | |
|---|---|---|---|---|---|
| 4,793,370 | A | * | 12/1988 | Perez | 135/69 |
| 4,910,927 | A | * | 3/1990 | Beatty | 135/66 |
| 4,962,781 | A | * | 10/1990 | Kanbar | 135/65 |
| 5,313,971 | A | | 5/1994 | Upshaw | |
| 5,318,068 | A | | 6/1994 | Haugen | |
| 5,325,879 | A | * | 7/1994 | Burns | 135/67 |
| 5,735,303 | A | | 4/1998 | Cole | |
| 5,746,236 | A | * | 5/1998 | Tilsley | 135/66 |
| 6,082,384 | A | * | 7/2000 | Cheng | 135/66 |
| 6,170,501 | B1 | * | 1/2001 | Cook | 135/67 |
| 6,206,018 | B1 | * | 3/2001 | Daniels | 135/69 |

FOREIGN PATENT DOCUMENTS

| | | |
|---|---|---|
| CA | 2003622 | 5/1990 |
| FR | 2255881 | 1/1974 |

* cited by examiner

*Primary Examiner*—Beth A. Stephan
(74) *Attorney, Agent, or Firm*—Santosh K. Chari; Orange & Chari

(57) ABSTRACT

An assistive device for persons with an injured or disabled leg includes a main body comprising a crutch to which is pivotally attached a supporting structure. To assist the person in walking, the device can be used as crutch in the known manner, and the supporting structure is maintained in the same plane as the crutch. When the person wishes to be seated, one end of the device is placed on the seat adjacent the person and the supporting structure of the device is pivoted out of the plane of the crutch to provide a support for the opposite end. In this manner, the crutch is positioned in a generally horizontal position and serves as an elongate support for the injured leg whereby the leg is maintained in a horizontal position while the person is seated,

9 Claims, 11 Drawing Sheets

AXILLARY CRUTCH

BACKGROUND OF THE INVENTION

1. Field of the Invention

The present invention relates to a crutch and more particularly to a crutch that assists a person with a leg injury in walking and that supports such leg when sitting.

2. Description of the Related Art

When a person suffers a leg injury such as a sprain or fracture, they rely on assistive devices to remain mobile. Such devices provide physical support so that the injured leg is not subjected to any stress during the healing period. An assistive device can be defined as any item, piece of equipment, or product system that is used to increase or improve flinctional capabilities of individuals with disabilities or injuries. A crutch is an example of as assistive device that is frequently prescribed to those who suffer from a leg injury in order to help such individual maintain their quality of life.

Crutches have traditionally assumed a static role in that they have simply been used to assist the injured individual in moving from one place to another. However, in situations where the individual assumes a sitting position, ahe injured leg often cannot be bent or cannot rest on the floor. Further, the injured leg must quite often be raised so as to prevent pooling of blood therein. In such circumstances, the injured leg must be placed on a chair, stool or other such support that enables the leg to be maintained in a raised or elevated position. However, in many instances, these types of supports are not available.

To address this problem, various solutions have been provided in the art wherein known axillary crutches are modified so as to be convertible to a leg support device. For example, in U.S. Pat. No. 5,318,068, there is taught a cast support device that can be attached to an axillary crutch. Such device comprises a hinged arm structure that is attached to the side of a cratch. When required, the crutch is laid flat on the ground and the structure is unfolded and locked in place to form a leg support structure. When the individual no longer requires the leg support, the device is collapsed and the crutch is used in the normal manner. Such device, however, includes various deficiencies. Firstly, the complex structure of the device makes it difficult to use and adds considerably to the weight of the crutch. Further, since the cratch is laid on the floor and used as a base for the support device, it poses a safety hazard to others that may be passing by.

A further leg support device is taught in U.S. Pat. No. 5,313,971. In this case, the device consists of a sling supported by two commonly Inown axillary crutches, which are biased against each other in a generally upright orientation. The support device includes a hood that covers the top ends of the crutches thereby holding the crutches in place. The device also includes a sling that hangs from the hood. Although relatively simple in structure, the device taught by this patent occupies a fair amount of space and becomes quite visible when assembled. Furthermore, the device is predicated upon having two axillary crutches available, which is not always the case. Finally, since the device is separate from the ctches, it may be misplaced or not available when needed.

U.S. Pat. No. 5,735,303 teaches yet another leg supporting device wherein a typical metal type axillary crutch is provided, at its lower end, with a pair of short, pivotally attached legs. Such legs are extended when the injured person requires to be seated and the top end of the crutch is placed on the person's chair, underneath the injured leg. The short legs of the crutch device are used to support the bottom end of the crutch on the floor. In this manner, the crutch becomes an elevated support structure on which the injured leg may be placed. Although the device taught in this patent is quite easy to use, the independent pivotal connection of the short legs requires them to be carefally positioned together so as to provide the desired support. Further, the un-hindered attachment of the legs to the crutch makes them quite unstable in that they may easily be knocked out of position when supporting a leg thereby possibly causing further injury to the leg being supported. In addition, the short support legs of this patent are not maintained in position when the crutch is used for walking. As such, the legs would be continually moving thereby creating a nuisance and, possibly, posing an injury risk.

The present invention seeks to obviate the degciencies of the leg elevating crutch devices known in the art.

SUMMARY OF THE INVENTION

In one aspect, the present invention provides an assistive device comprising a crutch having a support apparatus, the device being positionable in a first, walking orientation, wherein the device is used for assisting in walking, and a second, supporting orientation, wherein the device is used for supporting an injured leg in a generally horizontal position, and wherein:

the crutch includes a first pair of spaced, elongate support members, the members being connected at a first end by an axillary support, and connected at an opposite second end to a foot, the crutch firer including a hand grip, extending between and connected to the elongate support members, the hand grip being located between the axillary support and the foot;

the support apparatus includes a second pair of elongate members pivotally connected to the first pair of elongate members, between the first and second ends thereof, the second pair of members being substantially parallel to the first pair of members and being generally co-planar therewith when the device is in the first position; whereby, when the device is in the second position, one of the first or second ends is supported on a raised surface and the opposite end is supported by the supporting apparatus.

In another aspect, the present invention provides a method of forming an assistive device comprising a crutch having a support apparatus, the device being positionable in a first, walking orientation, wherein the device is used for assisting in walking, and second, leg supporting orientation, wherein the device is used for supporting an injured leg in a generally horizontal position, the method comprisitng:

a) providing a first crutch and a second crutch, the first crutch including a first pair of spaced, elongate support members, the members being connected at a first end by an axillary support, and connected at an opposite second end to a foot, the crutch flirter including a hand grip, extending between and connected to the elongate support members and located between the axillary support and the foot;

the second crutch including a second pair of spaced, elongate support members;

b) cutting a portion of the second crutch to provide lengths of the second support members, the lengths having first aind second ends; and, c) pivotally connecting the first ends of the lengths of the second cutch to the first crutch, whereby the second support members of the portion of the second crutch are generally parallel and co-planar with the first support members when the device is in the first position.

BRIEF DESCRIPTION OF THE DRAWINGS

These and other features of the preferred embodiments of the inivention will become more apparent in the following detailed description in which reference is made to the appended drawings wherein.

DESCRIPTION OF THE PREFERRED EMBODIMENTS

Figure 1:
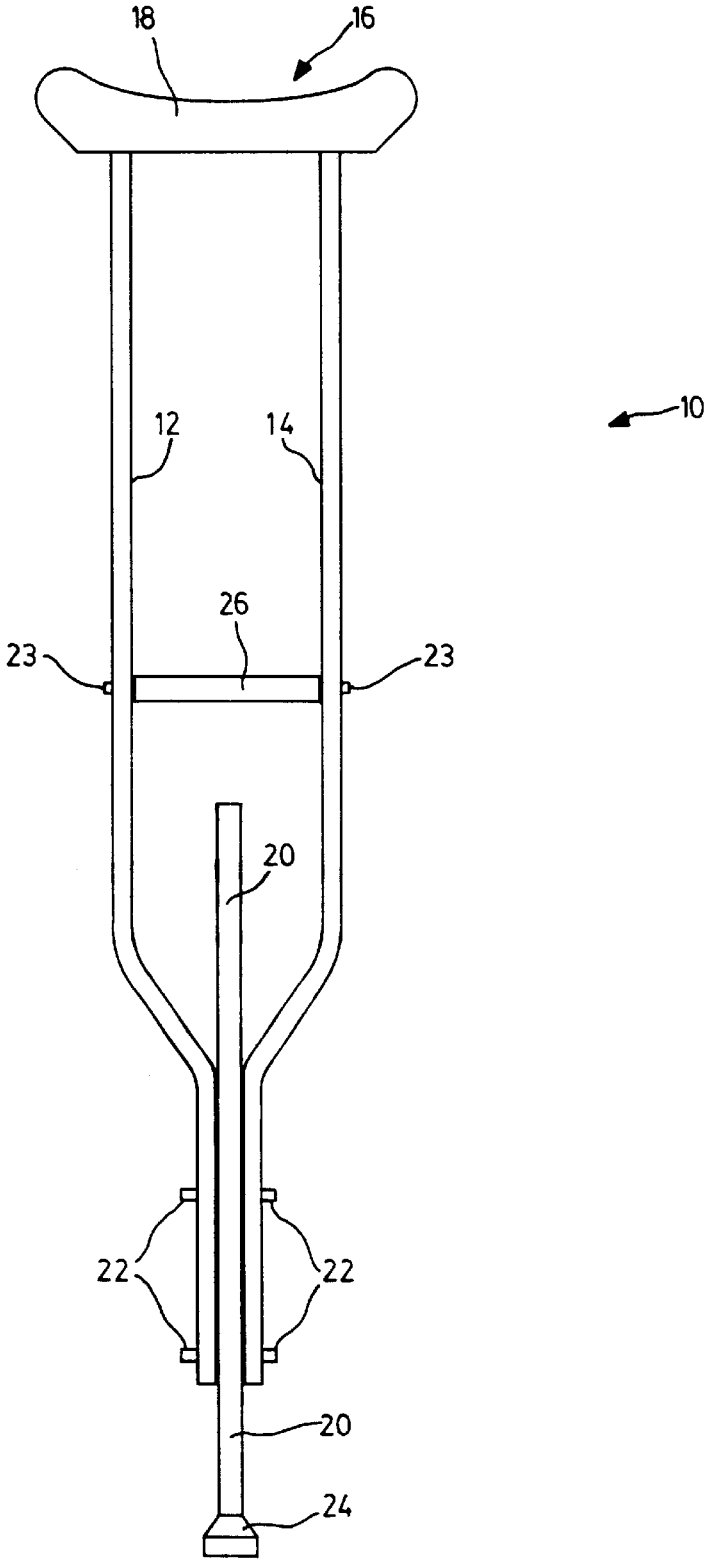
FIG. 1 is a front elevation of a crutch as known in the art.

FIG. 1 illustrates a typical wooden crLtch 10 as commonly known in the art. The crutch 10 includes of a pair of legs 12 and 14. The legs 12 and 14 are provided at the top end of the crutch 10 with an axillary support 16. Axillary support 16 includes a beam (not shown) extending transversely between legs 12 and 14 and serves to maintain such legs in a generally parallel position as shown. Axillary support 16 further includes a foam material or other such adding 18 so as to provide comfort for the person using the crutch. At the bottom end of the crutch 10, the legs taper towards each other and are joined to the sides of central leg 20. The legs 12 and 14 are joined to central leg 20 by means of fasteners 22 as are commonly known in the art. Such fasteners may include a threaded bolt extending through apertures (not shown) in legs 12, 14 and 20 and fastened with a hex nut or wing nut as required. As will be understood by persons skilled in the art, various other types of fasteners may be used. The apertures in each of the legs 12, 14 and 20 are arranged in alignment so that the fastener may pass through corresponding apertures thereby allowing the relative positions of the legs to be locked.

Central leg 20 terminates at the bottom of the crutch 10 with a foot 24, which may comprise a rubber cap as commonly known in the art.

The crutch 10 further includes ahandle 26 extending between legs 12 and 14 for grasping by the person using the crutch. The handle 26 is attached to the legs 12 and 14 by fasteners 23 which may be the same as fasteners 22 that are described above. For this purpose, both the legs 12 and 14 are provided with aligned apertures (not shown) along a portion of their lengths so that a bolt or the like to pass through. The handle 26 is provided with a central bore through which the bolt is passed. In this manner, the position of the handle with respect to its distance from the axillary support 16 may be adjusted to suit the individual requirements of the user. If needed, the handle 26 may be provided with padding so as to make the use of the crutch more comfortable.

As is also commonly known, a plurality of apertures may be provided in the legs 12, 14 mid 20 along the lengths thereof so as to allow for adjustment of the relative position of the central leg 20 with respect to the legs 12 and 14. In this manner, the length of the crutch can be adjusted to suit the dimensions of the user.

Figures 2A, 2B:
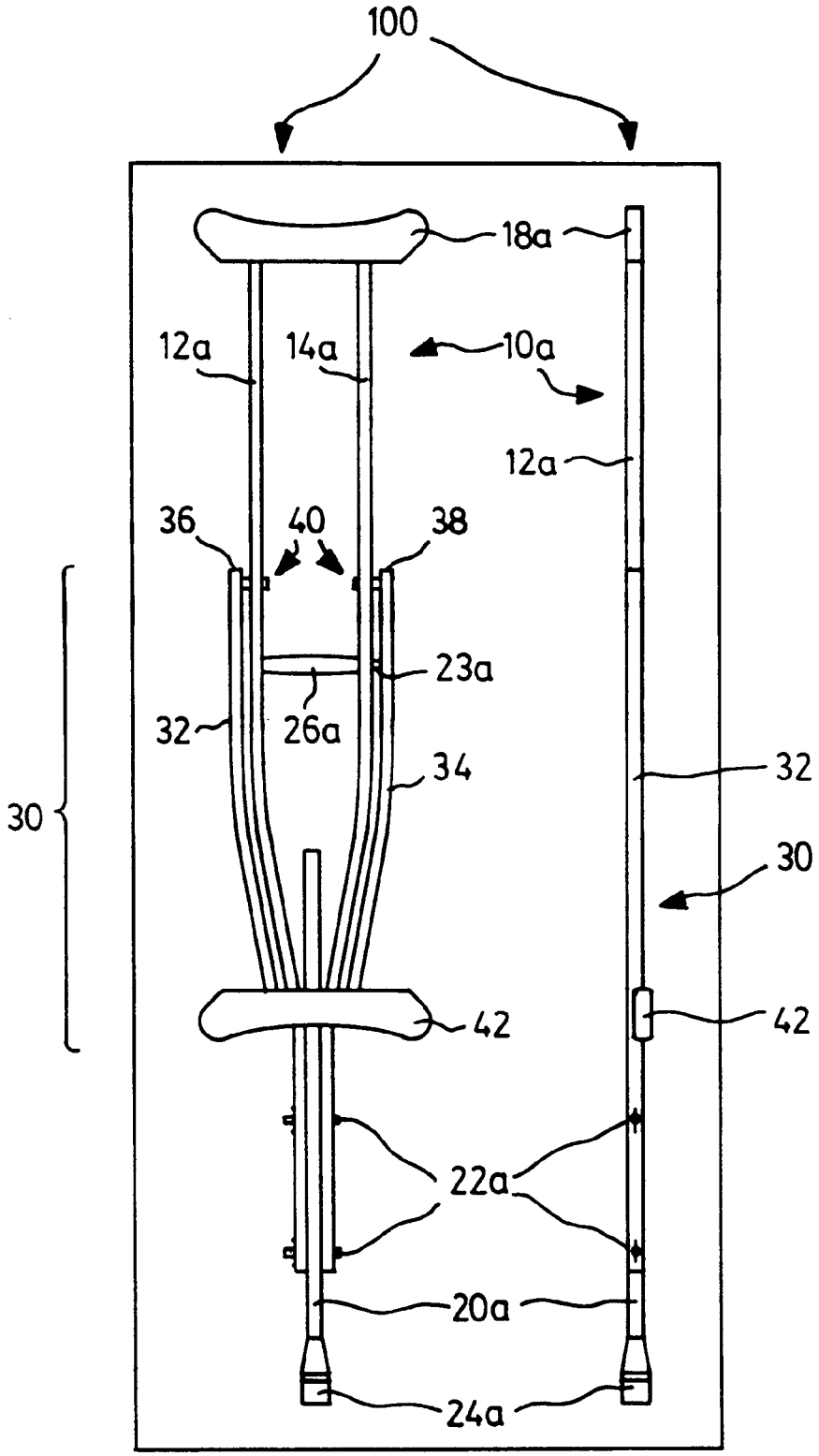
FIGS. 2A, 6A and 11A are front elevations of a modified crutch according to a preferred embodiment of the invention when in the mobility orientaion.
FIGS. 2B and 6B are, respectively, side elevations of the rnodified crutch of FIGS. 2A and 6A.

FIGS. 2A and 2B illustrate a preferred embodiment of the present invention wherein elements similar to those of FIG. 1 are identified with the same reference numeral but with the letter "a" added for clarity. In this embodiment, a portion of one crutch is cut and attached to another crutch, wherein the cut portion is used as a support stracture for sllpportng the crutch when used as a leg elevating device. In FIGS. 2A and 2B, the modified crutch 100 is shown with a support structure 30 in the folded, or walking orientation. As shown in FIG. 2A, the modified crutch 100 consists of a main body comprising a crutch 10*a* as is commonly known and illustrated in FIG. 1. The crutch of the invention 100 also includes an added support structure identified as 30, which, as indicated above, is preferably cut from another crutch so that it conforms to the contours of the crutch body 10*a*. Although the preferred embodiment contemplates that the support structure 30 is cut from another crutch (having a similar structure as the tnain body 10*a*), this is done in order to simplify the process of constructiing the crutch 100 of the present invention. It will be appreciated that the support structure may also be separately built to provide the desired dimensions.

Figure 4:
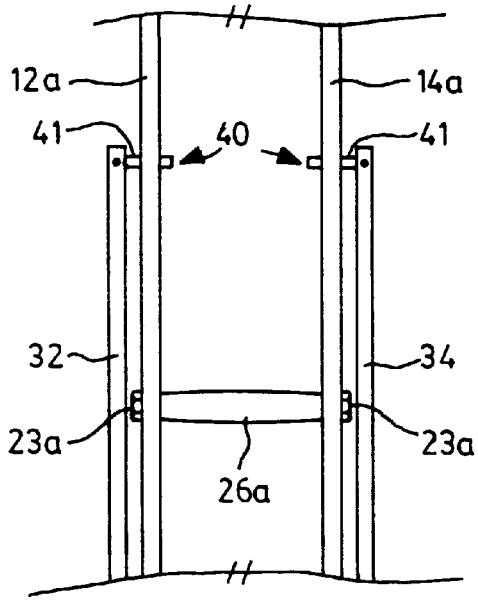
FIG. 4 is a putial ront elevation of the crutch of FIG. 2A illustrating an upper mid portion.

In the preferred embodiment, support structure 30 includes a pair of legs 32 and 34 with top ends 36 and 38, respectively. The legs 32 and 34 are, at their respective top ends 36 and 38, pivotally connected to legs 12*a* and 14*a*, respectively, of the main body 10*a* thereby allowing the legs 32 and 34 to be extendable away from the main body 10*a*. The legs 32 and 34 are connected to the legs 12*a* and 14*a* by means of commonly known fasteners 40. Such connection is more clearly illustrated in FIG. 4. As shown in FIG. 4, the fasteners 40 include a bushing 41 for separating the legs 32 and 12*a*, and 34 and 14*a*. Such bushing facilitates the pivotal movement of the support structure 30 with respect to the crutch 10*a* by slightly separating the respective legs 32 and 12*a*, and 34 and 14*a*, from each other thereby reducing any frictional contact between same. Various other connection means will be apparent to persons skilled in the art.

In the preferred embodiment, the support structure 30 is attached to the outer sides of legs 12*a* and 14*a* of crutch 10*a* and fastened to the crutch 10*a* with flush pin screws, using one of the empty handle apertures. In a preferred embodiment, the support structure 30 is made by cutting another crutch approximately 12" below the axillary support to provide the legs 32 and 34. These legs are then fastened to the main crutch body 10*a* whereby each leg of the support structure is pivotally connected to a respective legs 12 and 14 of the main crutch body 10*a*. The terminal ends of the legs 32 and 34 and then joined together by a base 42, which preferably consists of an axillary support cut from another crutch and, preferably, from the other crutch that originally supplied the support structure 30. As will be understood, the base 42 may also be separately made for the present purpose. Further detail of this construction is provided below.

Referring back to FIGS. 2A and 2B, the support structure 30 also includes, at the opposite ends from ends 36 and 38, a base 42. As mentioned above, the base 42 preferably comprises an axillary support cut from the other crutch referred to above, and to which are attached legs 32 and 34. As indicated in FIG. 2B and in FIG. 5, the base 42 is preferably provided with a notch 44 that ig large enough to accommodate the width of the crutch 10*a* when in the folded orientation. In this manner, when tlhe crutch is used for walking, the support structure 30 does not substantially protrude from the profile of the crutch, thereby reducing any interference in using the crutch as a walking aid.

Figure 3:
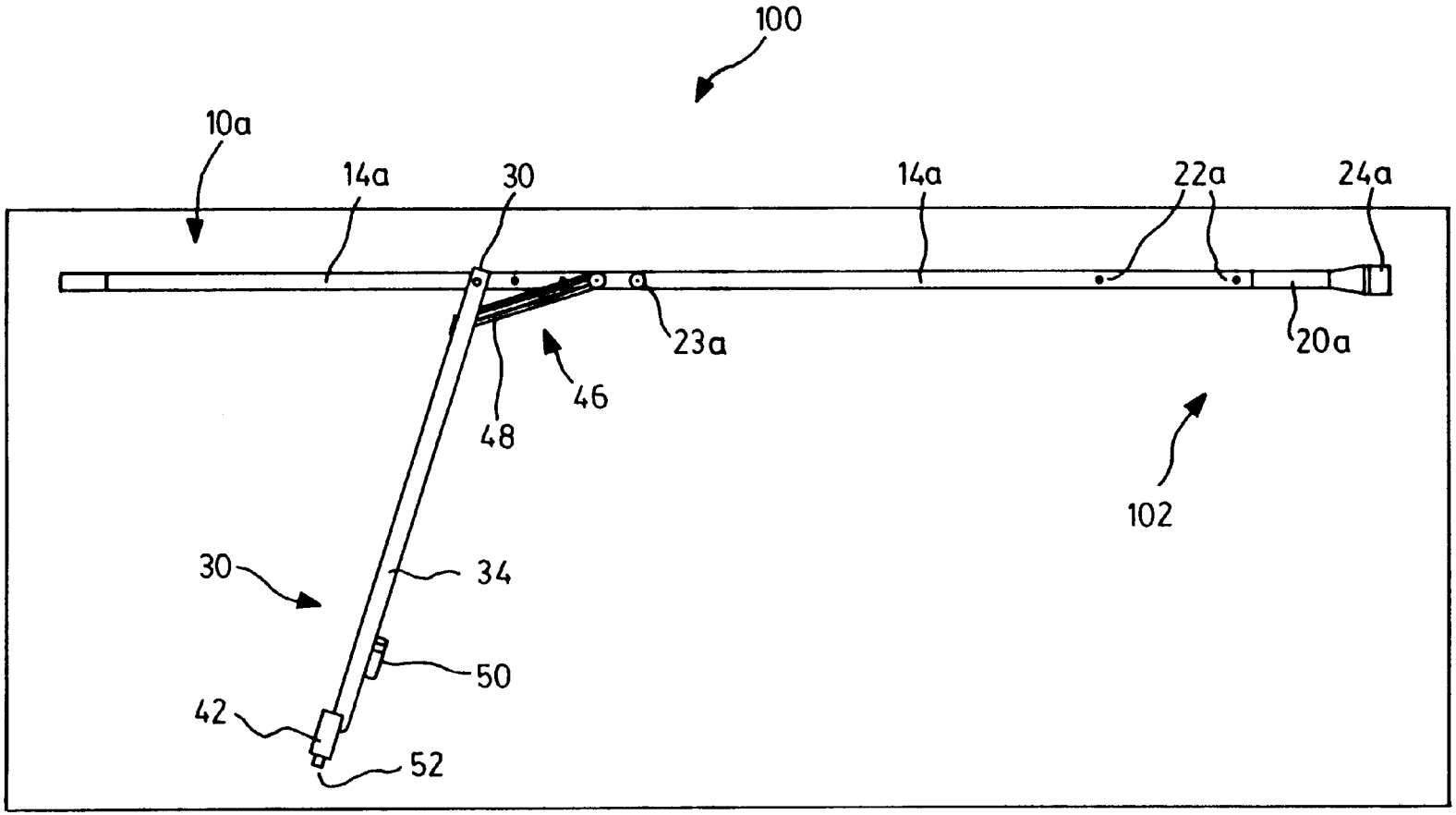
FIGS. 3 and 11B are side elevations of the crutch of FIG. 2 when in the leg supporting orientation.

FIG. 3 illustrates the crutch 100 of the invention when in the urnfolded state for use as a leg elevating or supporting device. The crutch 100 of FIG. 3 is used, therefore, when the person is seated and wishes to raise the injured leg. To place the crutch 100 in the orientation of FIG. 3, the support structure 30 is extended away from the main body 10*a* of the crutch 100 thereby pivoting the legs 32 and 34 about the fasteners 40. As shown in FIG. 3 (and as discussed further below), the support structure 30 is preferably pivoted to an angle exceeding 90°, and preferably to an angle of 100°, as measured from its folded state, for increasing stability of the device. This preferred angle is ensured by means of hinges 46 on each of legs 32 and 34. Each of the hinges 46 include a grooved bracket 48 slidably attached to each of pair of legs 12*a* and 32, and 14*a* and 34. In this manner, and as can be seen in FIG. 3, the extension of the support structure 30 is restricted from proceeding beyond a given angle, which angle is determined by the length of the groove of brackets 48. Various other hinge devices are contemplated for the invention.

As shown in FIG. 3, when the modified crutch 100 is used as a leg elevating device, the user, after extending the support structure 30, places the bottom end 102 of the crutch on the chair (or other type of seat) on which the user is seated, with the bottom end 102 adjacent the thigh, and places the base 42 of the support structure 30 on the floor, thereby providing a leg support comprising the crutch body 10*a*, which is now in a generally horizontal position and which is preferably generally parallel to the floor. The user then places the injured leg on the length of the crutch 100 such that the leg is supported by either the legs 12*a* and/or 14*a* of the crutch and/or by the handle 26*a*. In the preferred embodiment, the user places the rear of the ankle on the handle 26*a*.

In a preferred embodiment, the base 42 is also provided with feet 52 for ensuring a frictional grip on the floor it is resting on, thereby preventing sliding of the crutch when in use. In a preferred embodiment, the feet are made of a rubber material for ensuring a high degree of friction between the feet and the floor.

Figure 5:
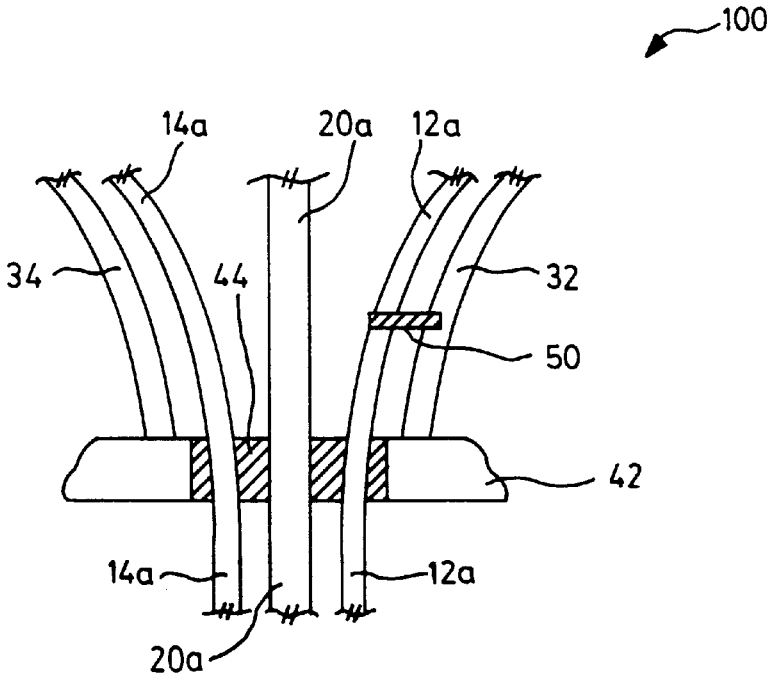
FIG. 5 is a partial front elevation of the crutch of FIG. 2A illustrating a lower mid portion.

Referiing back to FIG. 5, the modified crutch 100 is also provided with a locking mechanism 50, which is used to lock the support structure 30 against the main crutch body 10*a* when the crutch is used for the purpose of walking. In one embodiment, the locking mechanism comprises a latch. For effecting such locking, the support structure 30 is first folded back against the crutch body 10*a*. As mentioned above, the notch 44 allows the support structure 30 to lie substantially in the same plane as the main cratch body 10*a*. In this arrangcmcnt, te latch 50, shown attached to leg 32 of the support structure, is moved against leg 12*a* of the crutch main body 10*a*, thereby preventing the support structure 30 from being extended until such time as the latch is unblocked. As will be appreciated by persons skilled in the art, the latch 50 may be provided on either of legs 32 or 34 or also on both legs. Further, although a swing type latch is illustrated as one embodiment of the locking mechanism, various other devices for accomplishing the same result will be apparent to persons skilled in the art.

Figure 6A:
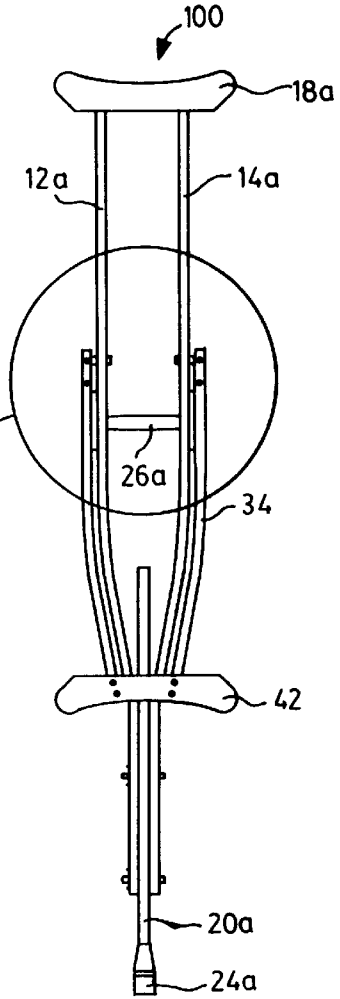
Figure 6C:
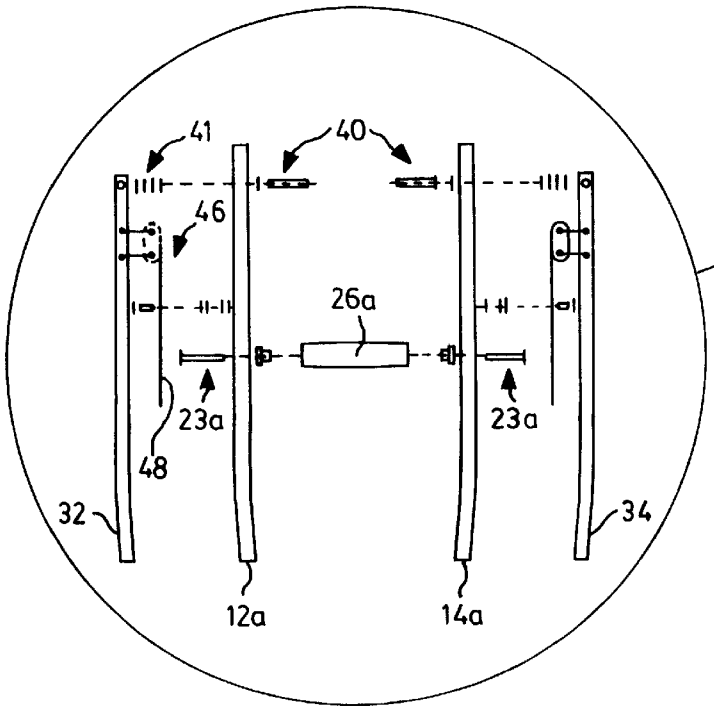
FIG. 6C is a partial exploded view of the crutch of FIG. 6A.
Figure 6D:
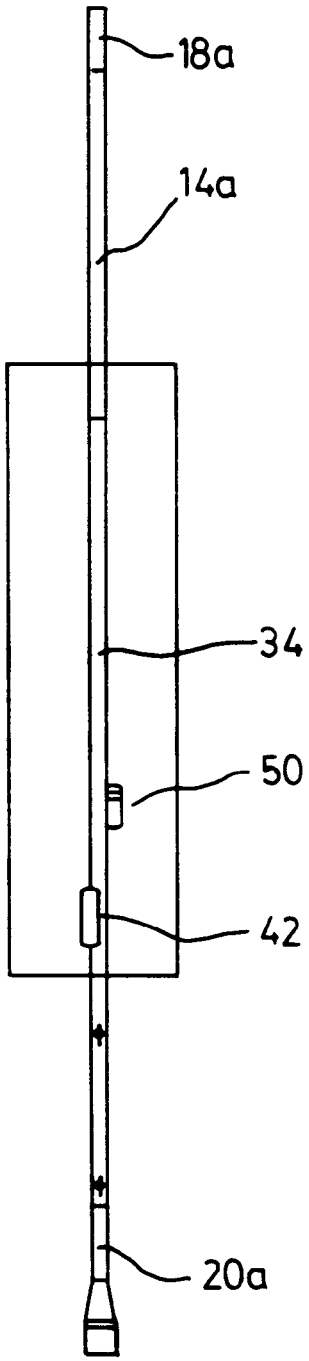
FIG. 6D is a partial exploded view of the crutch of FIG. 6A.
Figure 6B:
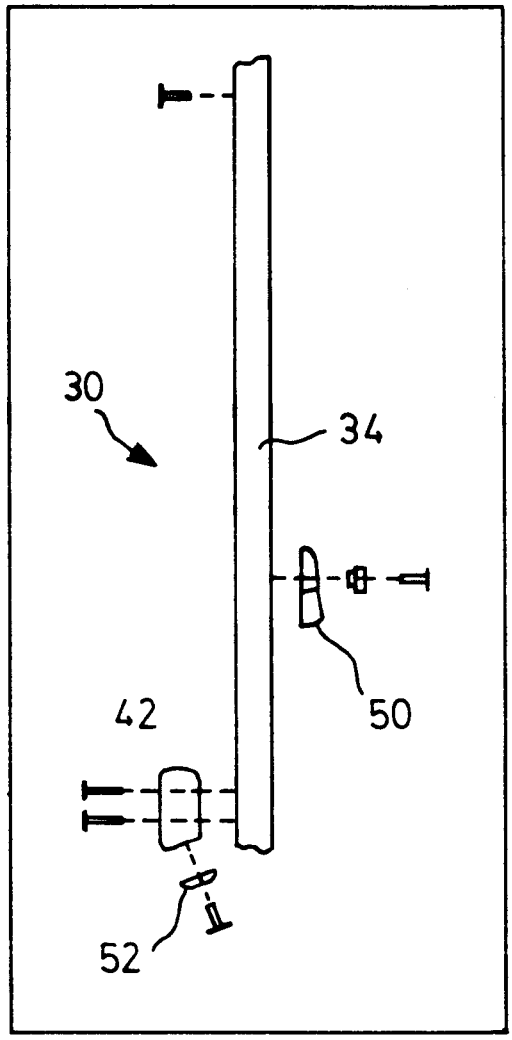

As mentioned above in the list of figures, FIGS. 6A and 6D are the same views as FIGS. 2A and 2B. FIGS. 6C and 6D, however, are, respectively, exploded views of portions of FIGS. 6A and 6B, which serve to illustrate the construction detail for the crutch 100 discussed above. Specifically, FIG. 6C illustrates a preferred manner in which the support structure 30 is attached to the main crutch body 10*a* including detail of the fasteners 40, the bushings 41 and the hinges 48. Further, FIG. 6D illustrates a preferred manner in which the base 42 and latch 50 are attached to the support structure 30. As also illustrated in FIG. 6D, the base 42 is provided with an angled portion 54 to which the feet 52 are preferably attached. The angled portion 54 allows the base 42 to more efficiently contact the floor when the crutch is unfolded to its leg elevating orientation. Such angled portion 54 is preferably provided since, as mentioned above, the support structure 30 is preferably rotated to an angle greater than 90°, and preferably to an angle of 100°. In such position, if the base 42 is provided with a flat bottom portion, only a side of such portion will contact the floor. Although the provision of an angled portion 54 is a preferred embodiment, other means of increasing contact with the floor will be apparent to persons skilled in the art. For example, the base itself may be flat and the feet 52 may include the require angle, thereby achieving the same result.

Figure 11B:
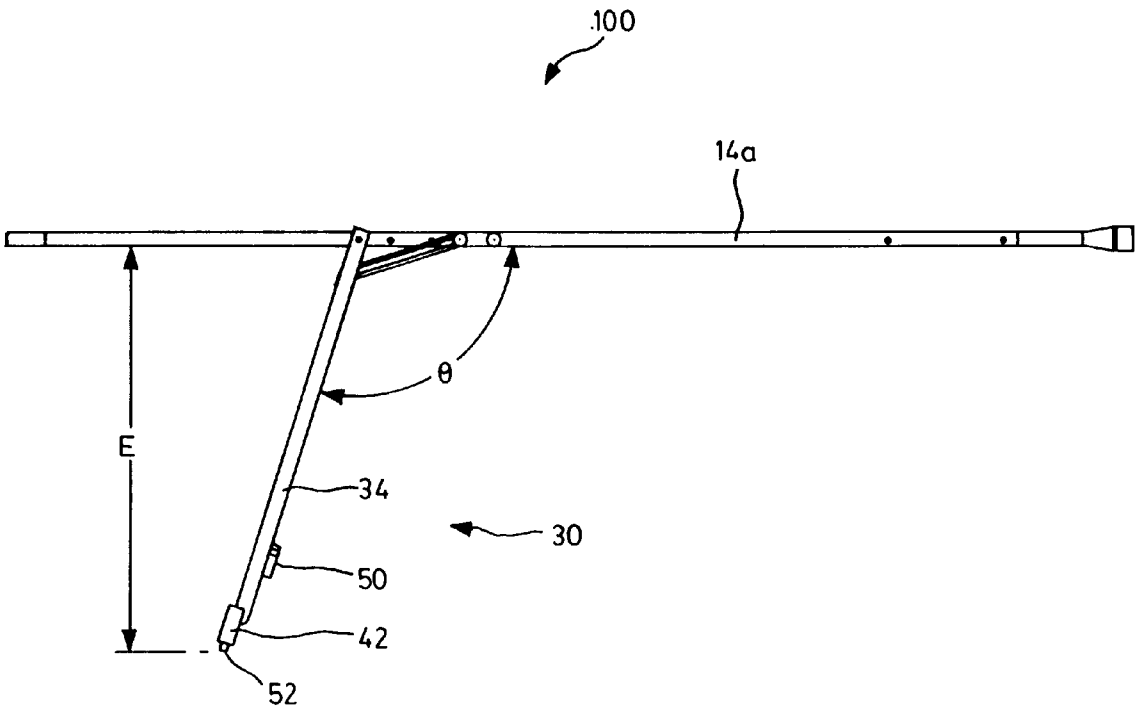
Figure 11A:
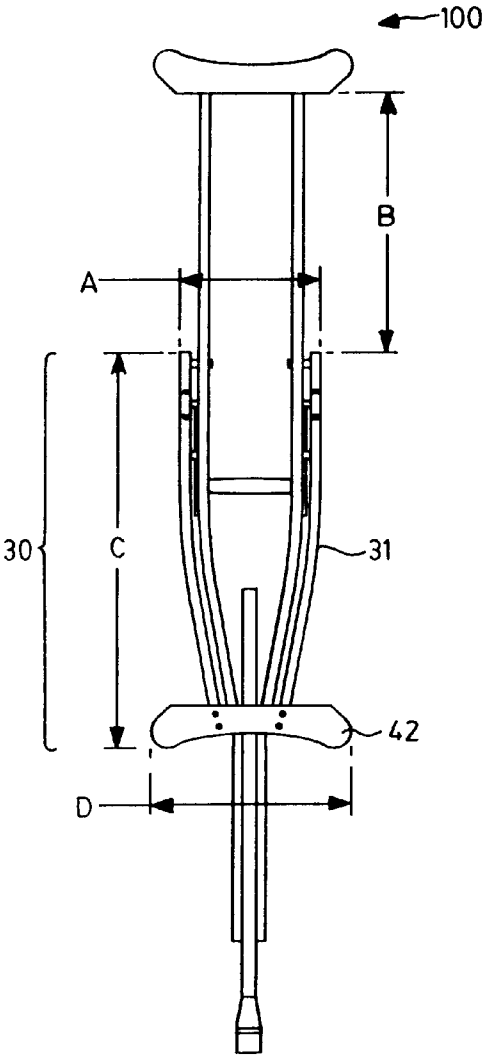

FIGS. 11A and 11B illustrate, respectively, the crutch of FIGS. 2A and 3 with specific reference to preferred dimensions. In the prefeed embodiment, such dimensions are as follows:

| Element | Value |
|---|---|
| A | 6.75" |
| B | 13.5" |
| C | 19.5" |
| D | 7.5" |
| E | 18.5" |
| θ | 100° |

It will be appreciated that the above dimensions will vary depending upon the crutch being used and upon the requirements of the user. The above dimensions are also for adult size crutches; similar crutches for children, will, of course, require different dimensions.

Figures 7A, 7B:
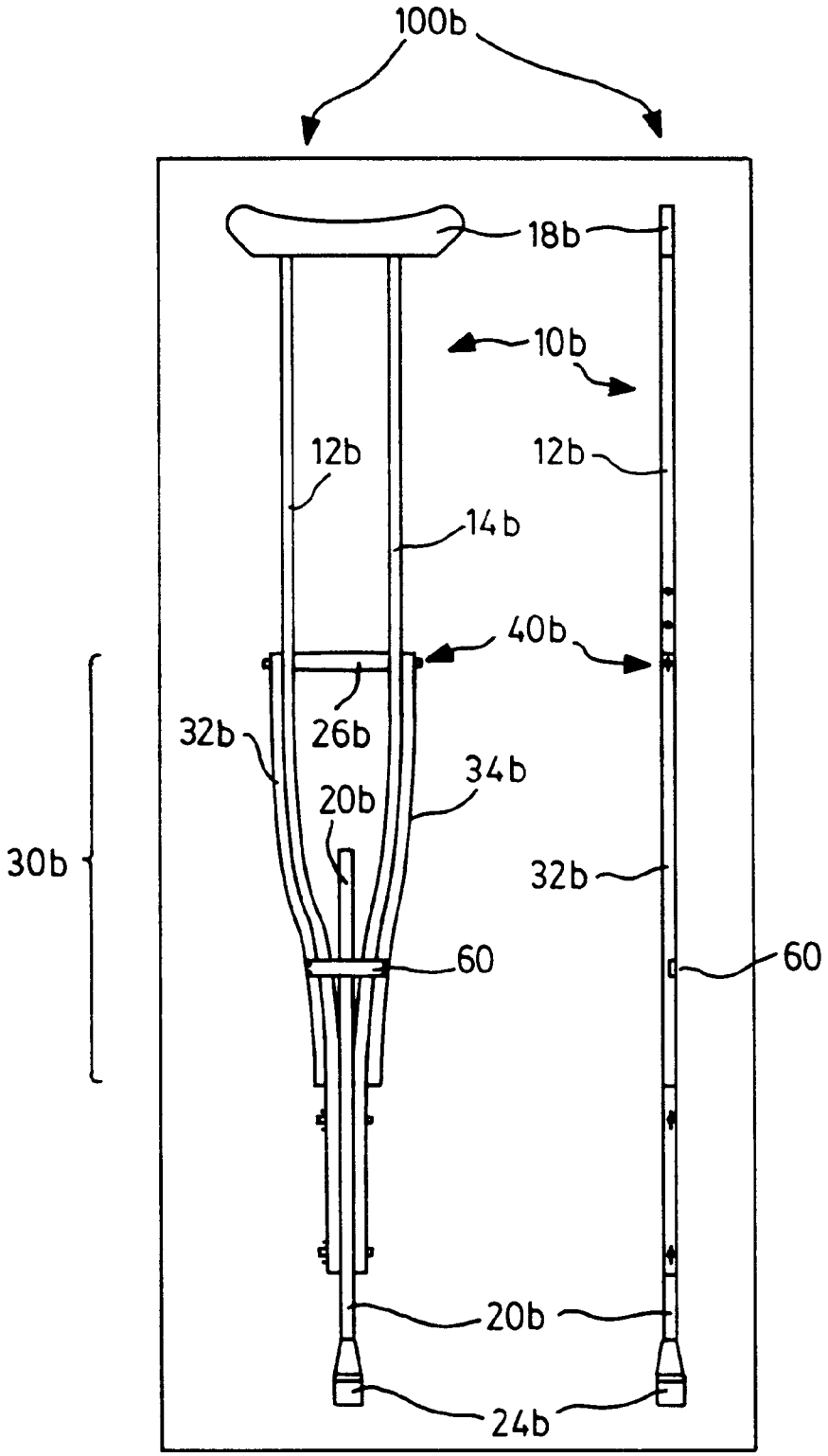
FIGS. 7A and 7B are front and side elevations, respectively, of another embodiment of the invention when in the mobility orientation.

Another embodiment of the invention is illustrated in FIGS. 7A and 7B, wherein elements that are similar to the elements illustrated in FIGS. 2–6 are identified with the same reference numeral but with the letter "b" added for clarity. In this embodiment, the crutch 100*b* of the invention includes a main body 10*b* ald a support structure 30*b*, which is generally the same as structure 30*a* described above. However, in this embodiment, the legs 32*b* and 34*b* do not include a base, such as 42 described above, at their terminal ends. Instead, the terminal ends of legs 32*b* and 34*b* contact the floor directly and are joined by a brace 60 that is used to maintain the terminal ends of legs 32*b* and 34*b* substantially together so that the support structure 30*b* is able to pivot about the main crutch body 10*b* in a unitary manner. Since, in this embodiment, the extra length of the base 42 is omitted from the support structure 30*b*, the top ends of the legs 32*b* and 34*b* may be joined to the main crutchibody 10*b* at a ower position such as, as illustrated, at the location where the handle 26*b* is connected. However, it will be apparent to persons skilled in the art that the location at which the support structure 30*b* (or 30*a* in the case of the previously described embodiment) can be varied depending upon the specific size of the crutch and on the height at which the injured leg is to be elevated.

As with the previous embodiment, the support structure of the crutch illustrated in FIGS. 7A and 7B may also be provided with feet (not shown) if necessary. In this case, such feet would preferably be attached to the terminal ends of the legs 32*b* and 34*b*. Further, the support structure 30*b* may be locked in the folded state by means of a locking device (also not shown) when the crutch is to be used as a mobility device. When used as a leg elevating device, the crutch of FIGS. 7A and 7B is unfolded and placed in the same position as with the embodiment described above.

Figure 8:
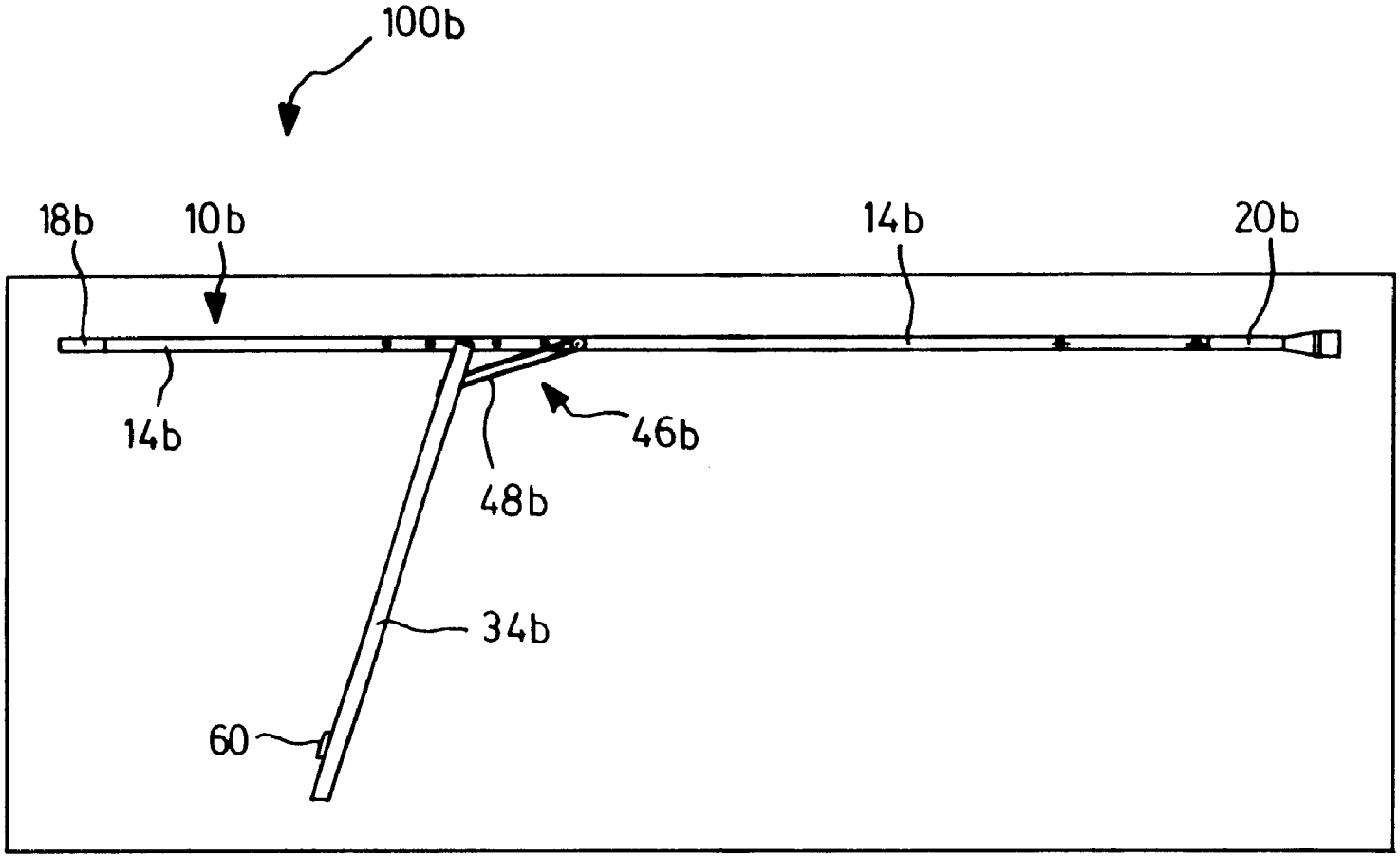
FIG. 8 is a side elevation of the crutch of FIG. 7 when in the leg supporting orientation.

FIG. 8 illustrates the embodiment of FIGS. 7A and 7B in the unfolded, leg elevating orientation. As can be seen, the legs 32*b* and 34*b* are provided with hinges 46*b*, including brackets 48*b*, for enablig the support sutmture 30*b* to be moved to its leg elevating position. As before, the preferred extension for the support structure 30*b* is greater than 90°, and preferably an angle of 100° fron its folded state. Further, as can be seen, the terminal ends of legs 32*b* and 34*b* are cut at an angle so as to maximize the surface of such ends contacting the floor when the crutch is used as a leg elevating device in the same manner as the angled portions of the base 42 in the previously described embodiment. As mentioned above, the terminal ends of the legs 32*b* and 34*b* may also be provided with feet, such as the rubber feet 52 mentioned above.

Figures 9A, 9B:
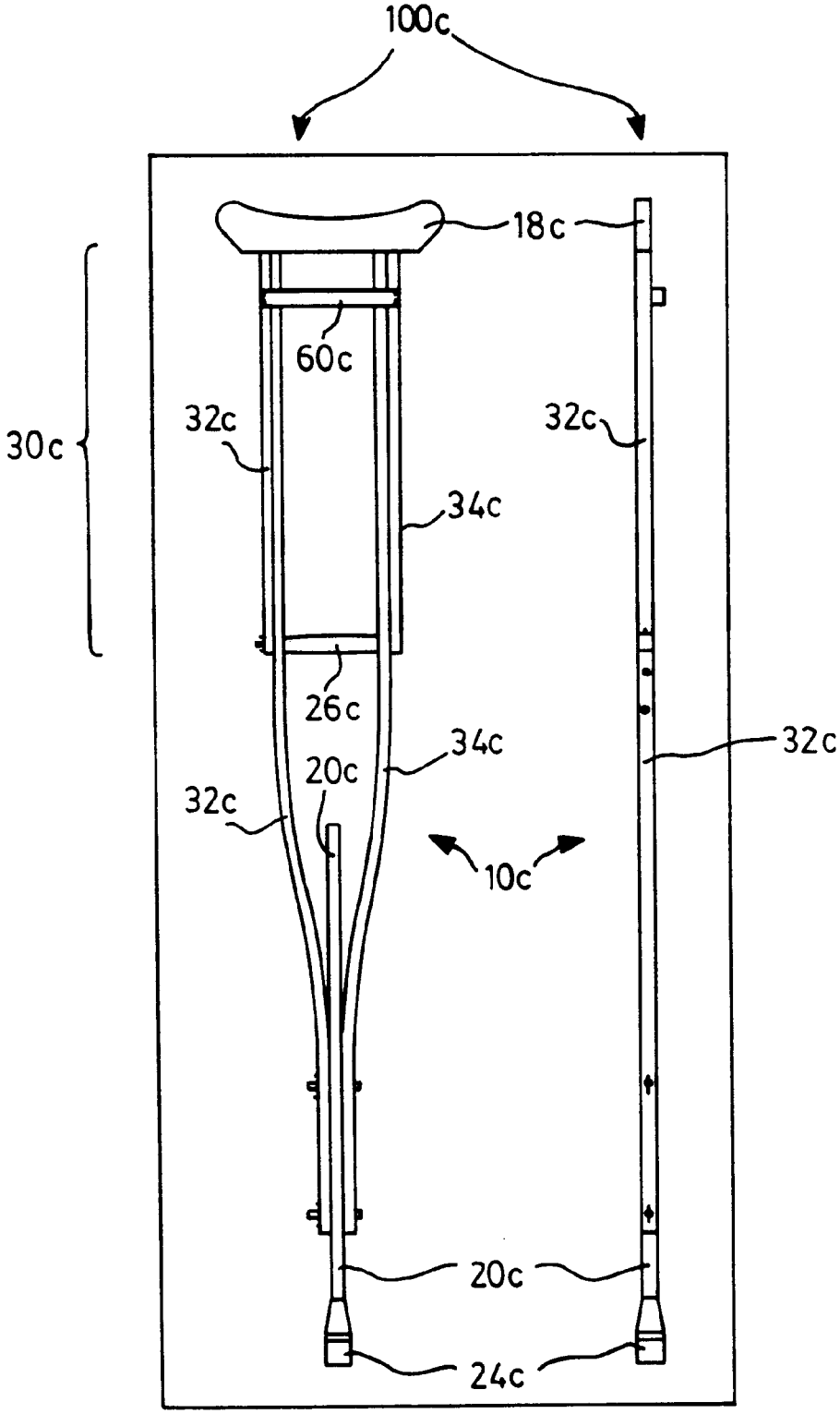
FIGS. 9A and 9B are front and side elevations, respectively, of another embodiment of the invention when in the imobility orientation.

A further embodiment of the invention is illustrated in FIGS. 9A and 9B, wherein elements that are similar to the elements described above, with respect to the previous embodiments, are identified with the same reference numeral but with the letter "c" added for clatity. hi this embodiment, the crutch 100*c* includes the same main crutch body 10*c* as described above, to which is attached a support structure 30*c* that is cut from another crutch. However, in this case, the support structure 30*c* comprises the generally straight, top portion of such other crutch. As can be seen, the support structure 30*c* includes legs 32*c* and 34*c*, that are generally parallel to the upper portions of the legs 12*c* and 14*c* of the main crutch body 10*c*. In this embodiment, the support structure, when in the folded, mobility (or walking) orientation, is locked in place close to the axillary support 18*c*.

Figure 10:
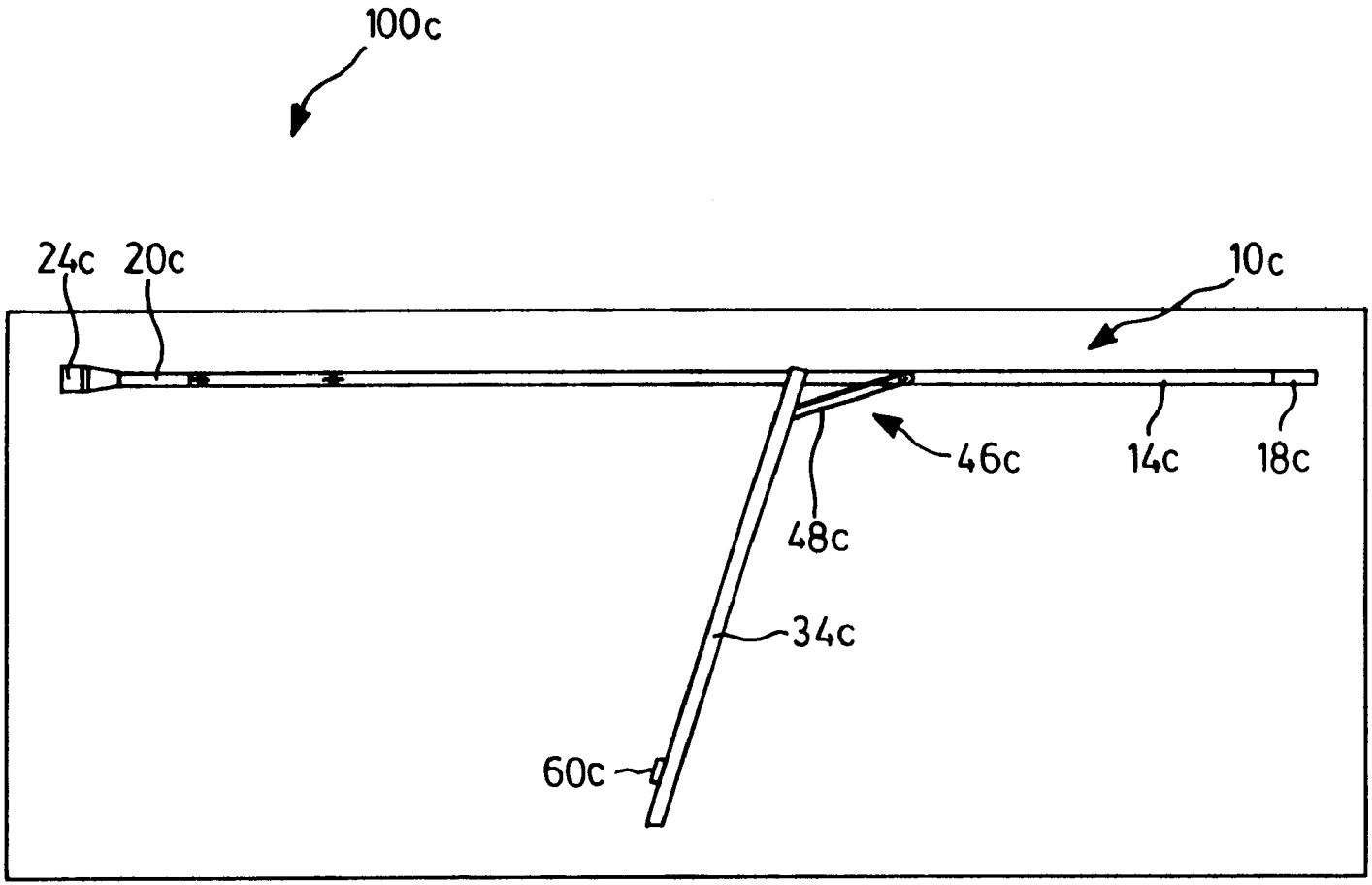
FIG. 10 is a side elevation of the crutch of FIG. 9 when in the leg supporting orientation.

When the crutch is to be used in the leg elevating orientation, as shown in FIG. 10, the support structure 30*c* is pivoted from the axillary support 18*c* towards the foot 24*c*. As will be noted, this motion is in the opposite direction from that described for the previously mentioned embodiments. As such, when used in the leg elevating orientation, the user, once seated and after unfolding the support structure 30*c* of the crutch 100*c*, places the axillary support 18*c* adjacent the tHigh, instead of the foot 24*c*, as in the previous embodiments. Generally, all other features of the crutch 100*c* are the same as the previously described crutches. As will be noted the terminal ends of the legs 32*c* and 34*c* contact the floor as in the embodiment of FIG. 7. In the case of the embodiment of FIGS. 9 and I0, the ends of the legs 32*c* and 34*c* are also provided with a brace 60*c* that performs the same Ufnction as the brace 60 mentioned above in relation to another embodiment. Once more, the temiial ends of the legs 32*c* and 34*c* are provided with angled portions to maxinize contact with the floor. Such ends may also be provided with feet as described above. The support structure 30*c* is also provided with binges 46*c* to ensure that such structure is pivoted to the desired position. In the preferred embodiment, as discussed above, the support structure 30*c* is pivoted to an angle slightly greater than 90°, and preferably to an angle of 100°.

As mentioned above, the crutch of the present invention is a dual purpose device that, in a mobility orientation, fuctions as a walking aid for a person with a leg injury (which may or may not require a cast). Further, the crutch of the invention, in a leg elevating orientation, functions as a support for the injured leg when the person is seated, at which time the injured leg is required to be raised off the floor and maintained in a generally horizontal position. To use the crutch of the invention as a leg elevating device, the following steps are followed:

1) the user sits on a chair or other type of seat and holds the crutch.
2) the user then unlocks the above mentioned latch, or other similar locking device, thereby releasing the support structure.
3) the support structure is pivoted beyond an angle of 90°, and preferably to an angle of 100°.
4) the crutch is positioned generally horizontally with one end resting on the chair and the support structure resting on the floor. In this position, the crutch is preferably generally parallel to the floor.
5) the injured leg is placed on the crutch preferably so that the handle of the crutch supports the ankle of the leg. In this manner, the injured leg is maintained in a horizontal position, also generally parallel to the floor, as long as needed.

If the user desires to rise and begin walking once again, the opposite series of steps is followed. Specifically, the leg is removed off the crutch, the support device is folded back against the crutch body and locked in place. The user then rises off the chair and uses the crutch as a walking aid as is commonly known.

It will be understood that users requiring two crutches, only one of such crutches need be that according to the present invention.

Although the invention has been described with reference to certain specific embodiments, various modifications thereof will be apparent to those skilled in the adt without departing from the spirit and scope of the invention as outlined in the claims appended hereto.

The embodiments of the invention in which an exclusive property or privilege is claimed are defined as follows:

1. An assistive device comprising a crutch having a support apparatus, said device being positionable in a first, walking orientation, wherein said device is used for assisting in walking, and a second, supporting orientation, wherein said device is used for supporting an injured leg in a generally horizontal position, and wherein:

said crutch includes a first pair of spaed, elongate support members, said members being connected at a first end by an axillary support, and connected at an opposite second end to a foot, said crutch further including a hand grip, extending between and connected to said elongate support members, said hand grip being located between said axillary support and said foot;

said support apparatus includes a second pair of elongate members pivotally connected to said first pair of elongate members, between the Argt and second ends thereof, said second pair of menbers being substantially parallel to said first pair of members and being generally co-planar therewith when said device is in said first position;

whereby, when said device is in said second position, one of said first or second ends is supported on a raised surface and the opposite end is supported by said supporting apparatus.

2. The device of claim 1 wherein said second pair of members have first and second ends and wherein the first ends of said second members are each connected to respective ones of said first members and said second ends of said second members are connected together.

3. The device of claim 1 wherein sad second pair of members are connected to said first pair of members proximal to said hand grip.

4. The device of claim 1 wherein said second pair of members are provided with a hinge to limit the pivoting of said second pair of members with respect to said first pair of members.

5. The device of claim 4 wherein said hinge permits said second pair of members to be pivoted by an angle greater than 90°.

6. The device of claim 5 wherein said angle is 100°.

7. The device of claim 1 further including a lock for maintaining said second members in said first position.

8. A method of forming an assistive device comprising a crutch having a support apparatus, said device being positionable in a first, walking orientation, wherein said device is used for assisting in walking, and second, leg supporting orientation, wherein said device is used for supporting an injured leg in a generally horizontal position, said method comprising:

a) providing a first crutch and a second crutch, said first crutch inclnding a first Pair of RPaced, elongate support members, said members being connected at a first end by an axillary support, and connected at an opposite second end to a foot, said crutch fiurther including a hand grip, extending between and connected to said elongate support members and located between said axillary support and said foot;

said second crutch including a second pair of spaced, elongate support members;

b) cutting a portion of said second crutch to provide lengths of said second support members, said lengths having first and second ends; and, c) pivotally connecting the first ends of said lengths of said second crutch to said first crutch, whereby said second support members of said portion of said second crutch are generally parallel and co-planar with said first support members when said device is in the first position.

9. The method of claim 8 furher including connecting said second ends of the lengths of second members whereby said lengths pivot together.

* * * * *